US008141710B2

(12) United States Patent
Palizzi

(10) Patent No.: US 8,141,710 B2
(45) Date of Patent: Mar. 27, 2012

(54) GAME RELATED BUNDLE PACKAGING

(75) Inventor: Steven Palizzi, Cave Creek, AZ (US)

(73) Assignee: Game World B.V. (NL)

( * ) Notice: Subject to any disclaimer, the term of this patent is extended or adjusted under 35 U.S.C. 154(b) by 0 days.

(21) Appl. No.: 12/408,107

(22) Filed: Mar. 20, 2009

(65) Prior Publication Data

US 2010/0236950 A1 Sep. 23, 2010

(51) Int. Cl.
*B65D 71/00* (2006.01)
*B65D 85/00* (2006.01)
*B65D 25/54* (2006.01)

(52) U.S. Cl. ..... 206/579; 206/459.5; 206/778; 206/782

(58) Field of Classification Search ..... 206/305, 206/320, 459.5, 569, 579, 776–778, 782, 206/831; 40/312
See application file for complete search history.

(56) References Cited

U.S. PATENT DOCUMENTS

| | | | | |
|---|---|---|---|---|
| 1,454,888 | A * | 5/1923 | Green | 206/831 |
| 3,858,717 | A * | 1/1975 | Peters | 206/459.5 |
| 5,067,609 | A * | 11/1991 | Stout | 206/216 |
| 5,882,611 | A * | 3/1999 | Williams et al. | 206/569 |
| 5,887,716 | A * | 3/1999 | Williams et al. | 40/312 |
| 6,179,122 | B1 * | 1/2001 | Moncrief et al. | 206/320 |
| 6,313,982 | B1 * | 11/2001 | Hino | 206/320 |
| 6,523,694 | B2 * | 2/2003 | Lux et al. | 206/782 |
| 6,899,222 | B2 | 5/2005 | Jones et al. | |
| 7,044,305 | B2 * | 5/2006 | Girondi et al. | 206/778 |
| D552,466 | S | 10/2007 | Proudfit | |
| 2002/0017479 | A1 * | 2/2002 | Neal | 206/782 |
| 2005/0092635 | A1 | 5/2005 | Jones et al. | |
| 2007/0227923 | A1 * | 10/2007 | Kidakarn | 206/320 |

FOREIGN PATENT DOCUMENTS

GB 2189465 A 10/1987

OTHER PUBLICATIONS

"European Application Serial No. EP10157232, European Search Report dated Jun. 15, 2010", 2 pgs.

* cited by examiner

*Primary Examiner* — Bryon Gehman
(74) *Attorney, Agent, or Firm* — Schwegman, Lundberg & Woessner, P.A.

(57) ABSTRACT

A game related bundle packaging has a first side and a second side. The bundle packaging can hold a game console in its original packaging at a predetermined position and at least one game related item in its original packaging at another predetermined position. The first side includes a first and at least a second window. The first window has a first shape and size at a first position on the first side and reveals a first area of interest of the original packaging of the game console when the game console is placed in the bundle packaging. The second window has a second shape and size at a second position on the first side and reveals a second area of interest of the original packaging of the game related item when the item is placed in the bundle packaging.

9 Claims, 10 Drawing Sheets

GAME RELATED BUNDLE PACKAGING

BACKGROUND

The present invention relates to a game related bundle packaging. Game console bundles, i.e. a box or packaging typically including a specific type of game console, e.g. like the well-known Playstation 3 (PS3), Playstation 2, Playstation Portable (PSP), Nintendo DS, Nintendo DS lite, Nintendo DSi, Nintendo Wii, Microsoft Xbox 360, etc., and a game and/or a game console controller for the particular game console, are popular with first time customers of the particular game console since typically such game bundles are offered at a lower price compared to purchasing the included items separately. Some times a bundled game is essentially free since a bundle with a console and a game may cost the same as the console itself if purchased alone. When customers buy a new console they typically want at least one game to go with it (to have something to play on the console) and perhaps also at least one additional game console controller and/or other game accessories.

The specific contents of such typical game bundles are typically defined by the specific console manufacturer, which leaves retailers of game consoles and related products with little or no freedom to put their own game bundle together. Often such bundles also only include a game from a so-called first party publisher or developer, i.e. from a party related to the manufacture of the specific game console like Sony, Nintendo, Microsoft, etc. (or one of their relevant divisions), and not from so-called third party publishers or developers, i.e. from a party not related to the manufacture of the specific game console like Electronic Arts, Ubisoft, Vivendi, Activision Blizzard, etc. (or one of their relevant divisions), which may limit the choice for a new customer in relation to the availability of games that are available as part of a bundle.

Furthermore, the margin for retailers on a game console is typically very low whereas the margins for games and/or accessories are larger. A game console may typically even be sold at cost price by the retailer, as the retailer hopes to generate revenue by selling additional games and/or game related accessories. The margin for retailers on a game bundle from a console manufacturer is typically also relatively low, and the inclusion of a game and/or game accessory already may keep the customer from buying additional games or game related accessories or at least fewer than if no games and/or accessories were included in a bundle.

Additionally, such typical game bundles packaging has its graphical design specially made to indicate which game and/or game accessory that are included with the game bundle thereby requiring a special layout and specific printing and/or manufacturing run for that particular game bundle packaging. When an additional game bundle is put together then a new design is done requiring yet another printing and/or manufacturing run, etc.

Patent specification U.S. Pat. No. 6,899,222 discloses a game controller packaging with limited consumer access where the game controller has at least one button and at least one directional control device wherein the game controller is positioned within the packaging so that at least one button is accessible.

SUMMARY

In one aspect, the invention provides a game related bundle packaging. The game related bundle packaging includes a first side and a second side. The game related bundle packaging is capable of holding a specific type of game console in its original packaging at a predetermined position and at least one game related item in its original packaging at another predetermined position. The first side includes a first window and at least a second window. The first window is of a predetermined first shape and size at a first predetermined position on the first side adapted to reveal at least a first area of interest of the original packaging of the specific game console when the specific game console is placed in the game related bundle packaging. The at least a second window is of a predetermined second shape and size at a second predetermined position on the first side adapted to reveal at least a second area of interest of the original packaging of the at least one game related item when the game related item is placed in the game related bundle packaging.

Various embodiments can include one or more of the following features. The game related item can be at least one console game, at least one game controller, at least one game accessory, at least one game hint book or guide, or various combinations thereof. The first window and/or second window can be a cut-out or a transparent portion in the game related bundle packaging. The at least first area of interest can include information relating to a manufacturer of the specific game console, a name of the specific game console, a barcode of the original packaging of the specific game console, technical specifications, commercial information, and/or at least a part of a picture or image showing the specific game console.

The at least second area of interest can include information relating to an age rating, at least a part of a cover of a console game, a barcode of the original packaging of the game related item, number of players for a console game, technical specifications, commercial information, and/or online capabilities. The at least first area of interest can include information relating to a manufacturer of the specific game console, a name of the specific game console, a barcode of the original packaging of the specific game console, and/or at least a part of a picture or image showing the specific game console and the at least second area of interest can include information relating to an age rating, at least a part of a cover of a console game, a barcode of the original packaging of the game related item, number of players for a console game, and/or online capabilities.

One or more identifiers of a retailer of the game related bundle packaging can be included. A voucher, a coupon, and/or a redeemable code of a predetermined value being redeemable by a retailer of the game related bundle packaging can be included. The game related bundle packaging can include one or more additional windows on the second side and/or on additional sides of the game related bundle packaging adapted to reveal at least one additional area of interest. Printed information can be included. The printed information can include one or more of a game console name, a game console logo, a name of a developer or distributor of a game, a gaming accessory name, a gaming accessory logo, a game name, a game logo, a game cover, a design of a game, and advertising information.

Various embodiments can include one or more of the following advantages. One or more drawbacks described above are alleviated, at least to some extent. The need for a specific design and/or printing or manufacturing run for a game bundle packaging can be avoided. Retailers can put together a specific bundle of items. A game related bundle packaging can be provided for a specific game console and a specific game related item in an expedient manner.

BRIEF DESCRIPTION OF THE DRAWINGS

These and other aspects of the invention will be apparent from and elucidated with reference to the illustrative embodiments shown in the drawings, in which.

DETAILED DESCRIPTION

Figure 1:
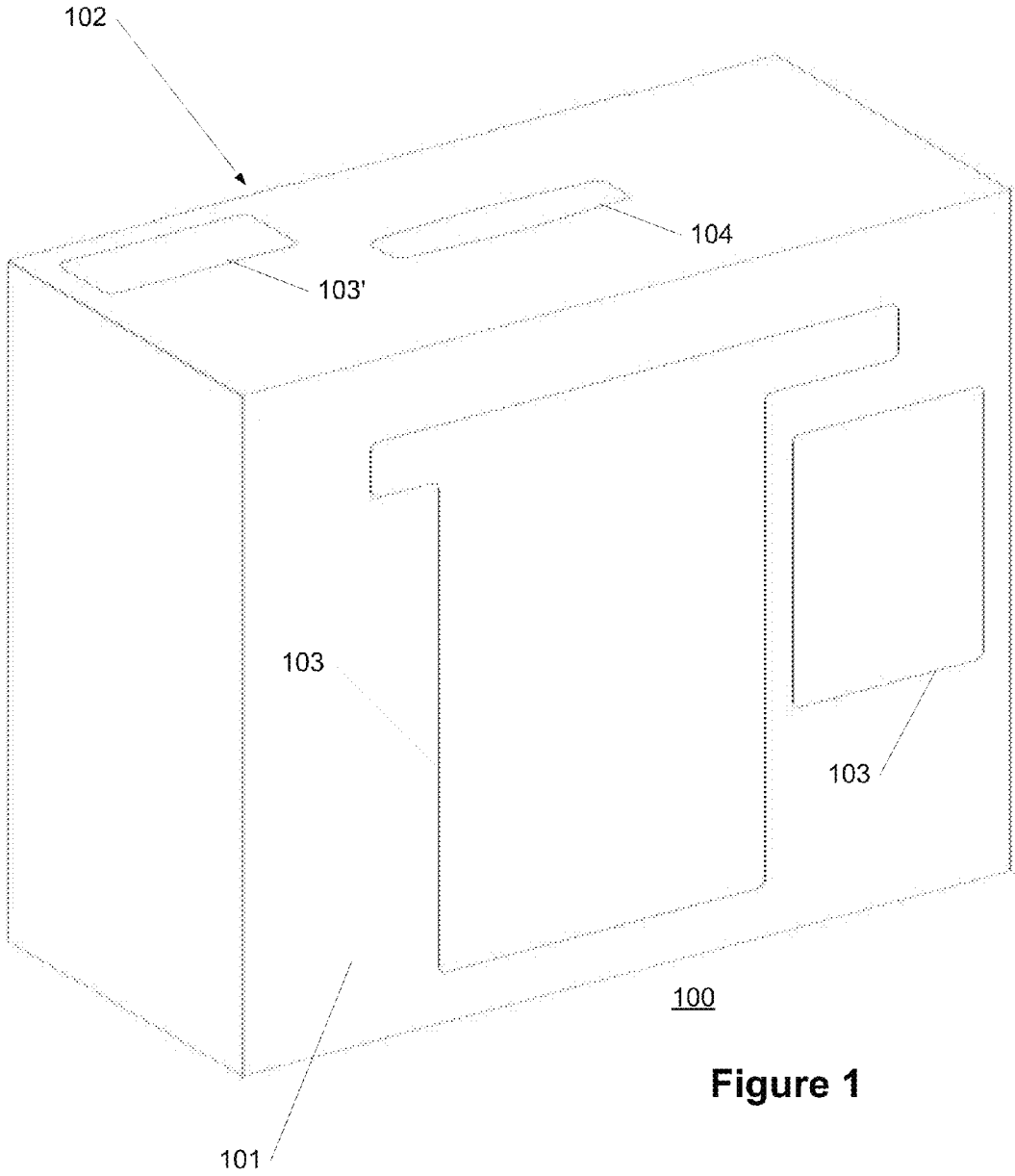
FIG. 1 schematically illustrates a perspective view of one embodiment of a game related bundle packaging in a folded state.

FIG. 1 schematically illustrates a perspective view of one embodiment of a game related bundle packaging. Shown is a game related bundle packaging (100) in a folded state comprising a first side (101) and a second side (not specifically shown but indicated by arrow 102). The game related bundle packaging (100) is capable of holding or containing a specific type of game console (not shown), e.g. a PS3, a Wii, a DS, a DS lite, a DSi, a PSP, an Xbox 360, etc. in its original packaging at a predetermined position. The exemplary embodiment shown in FIG. 1 is designed to hold a PS3 game console in its original packaging.

The game related bundle packaging (100) is also capable of holding at least one game related item (not shown) in its original packaging at another predetermined position.

The at least one game related item may e.g. be at least one console game, at least one game controller, at least one game accessory, at least one game hint book or guide, and combinations thereof.

The exemplary embodiment of FIG. 1 is designed to hold a PS3 game in its original packaging.

The first side (101) comprises a first and at least a second window (103). The first window is of a predetermined first shape and size and is located at a first predetermined position on the first side (101) so that at least a first area of interest of the original packaging of the specific game console is viewable from outside the game related bundle packaging (100) by a person when the game console is placed in the game related bundle packaging (100).

The second window (103) is of another predetermined second shape and size being at a second predetermined position on the first side (101) so that at least a second area of interest of the original packaging of the game related item is visible from outside the game related bundle packaging (100) by a person when the game related item is placed in the game related bundle packaging.

The game related bundle packaging (100) may also comprise one or more additional windows (103') on the second side (102) and/or on additional sides that can make other parts of the original packaging of an enclosed game console and/or an enclosed game related item visible. In the shown exemplary embodiment of FIG. 1, additional windows (103') are located on the top side to show additional information.

The game related bundle packaging (100) may also comprise a cut-out, window, etc. for different purposes, e.g. a cut-out (104) for accommodating a handle of the original packaging for a game console, e.g. like a PS3 packaging has.

The first window and/or any additional windows may e.g. show information relating to a manufacturer of the specific game console (e.g. company name), a name of the specific game console, a barcode of the original packaging of the specific game console, technical specifications (e.g. size of an included hard disk drive, wireless capabilities, output display resolution, HDMI enabled, etc.), commercial information, at least a part of a picture or image showing the specific game console, etc. This makes it readily identifiable to a customer which specific game console is included in the bundle packaging (100).

The second window and/or any additional windows may e.g. show information relating to an age rating (e.g. ESBR rating), at least a part of a cover of a console game, a barcode of the original packaging of a game related item, number of players for a console game, technical specifications, commercial information, online capabilities, and/or etc. In this way, it is readily identifiable to a customer which specific game related item(s) that is included in the bundle packaging (100).

Instead of showing the barcode of the original packaging for the game console or game related item, a specific barcode for the entire bundle can also be printed or the like on the game related bundle packaging.

The windows (103, 103') may e.g. be a cut-out, i.e. simply a missing part of materials, or a transparent portion in the game related bundle packaging (100), or some other alternative way of showing contents inside the game related bundle packaging (100).

The exemplary embodiment of FIG. 1 will in this way show relevant and/or interesting parts of the original packaging of the specific console and of a specific game.

As the game related bundle packaging can be designed for a specific game console and a specific game related item, a specific bundle may be combined as the items and console has a standard original packaging size. So, a retailer may combine a bundle more readily and more suitable to the customers' liking. Also additional revenue may be generated as the retailer can include a game related item with a better margin and/or being in higher demand.

According to a further aspect, the game related bundle packaging (100) comprises a voucher, a coupon, and/or a redeemable code (not shown) of a predetermined value being redeemable at or by a retailer of the game related bundle packaging (100). This may give the advantage that the retailer will experienced increased turn-over as the customer will be more likely to come back to the retailer of the game related bundle.

The game related bundle packaging (100) may comprise one or more inlays (not shown; see e.g. FIG. 4) or the like to keep or support the items in their proper locations.

According to an additional aspect, the game related bundle packaging (100) may comprise one or more identifiers of a retailer of the game related bundle packaging (100). This may e.g. be in the form of a company name, logo, etc.

Furthermore, the game related bundle packaging (100) may comprise one or more identifiers of the manufacturer of the game related bundle packaging (100) or the game related bundle packaging (100) itself. This may e.g. be in the form of a company name and/or logo or a product name and/or logo.

The game related bundle packaging may also comprise printed information, e.g. one or more of a game console name, a game console logo, a name of a game console manufacturer, a name of a developer or distributor of a game, a gaming accessory name, a gaming accessory logo, a game name, a game logo, a game cover, a design of a game, and advertising information. This may require the consent of the product manufacturer.

Figure 2:
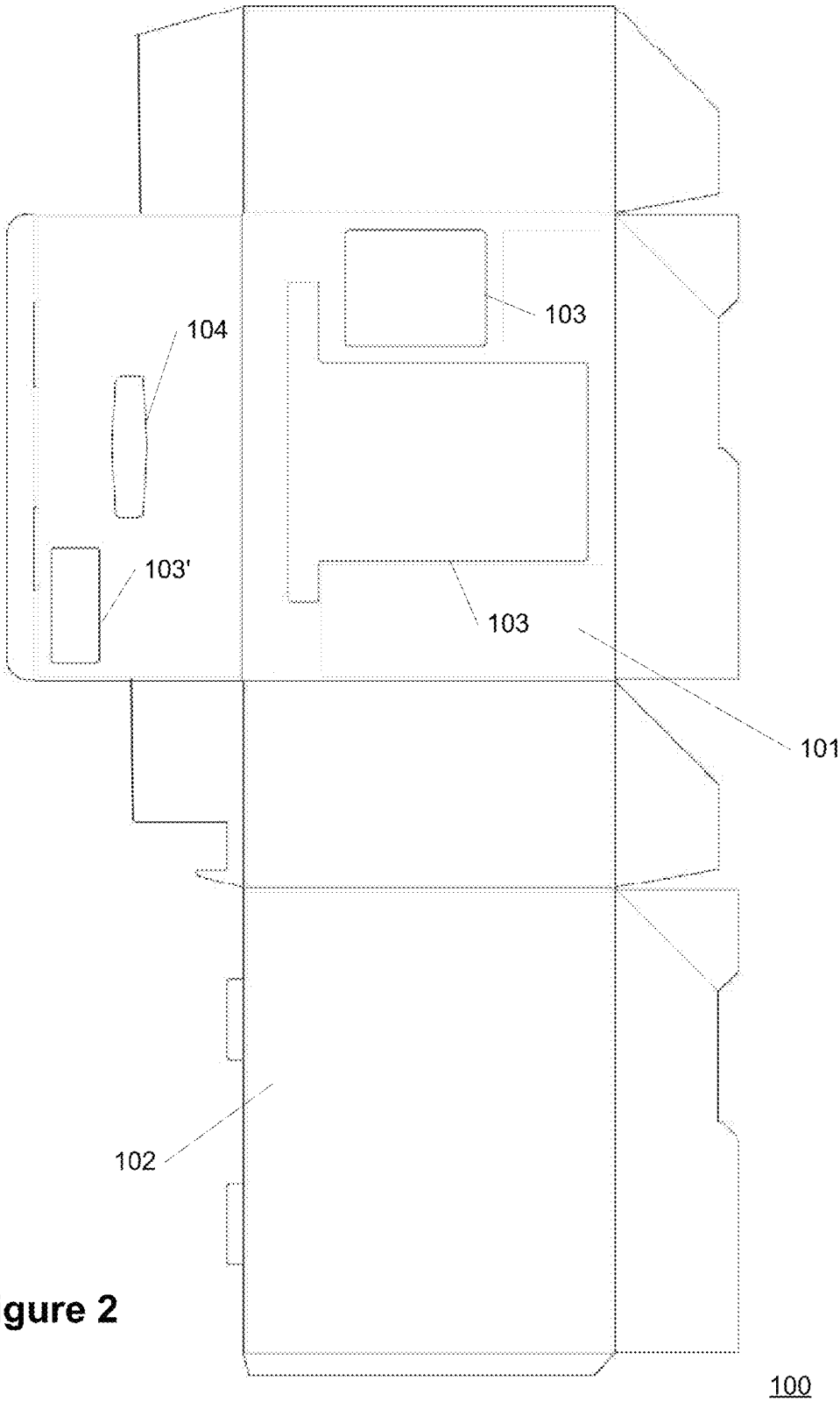
FIG. 2 schematically illustrates a view of the game related bundle packaging of FIG. 1 in an un-folded state.

FIG. 2 schematically illustrates a view of the game related bundle packaging of FIG. 1 in an un-folded state. Shown is game related bundle packaging (100) in an un-folded state comprising a first side (101), a second side (102), and additional sides (a left, a right, an upper and a bottom side or segments thereof). Also shown are an additional window (103') on an upper side and a cut-out (104) for accommodating a handle of the original packaging for a game console.

Figure 3:
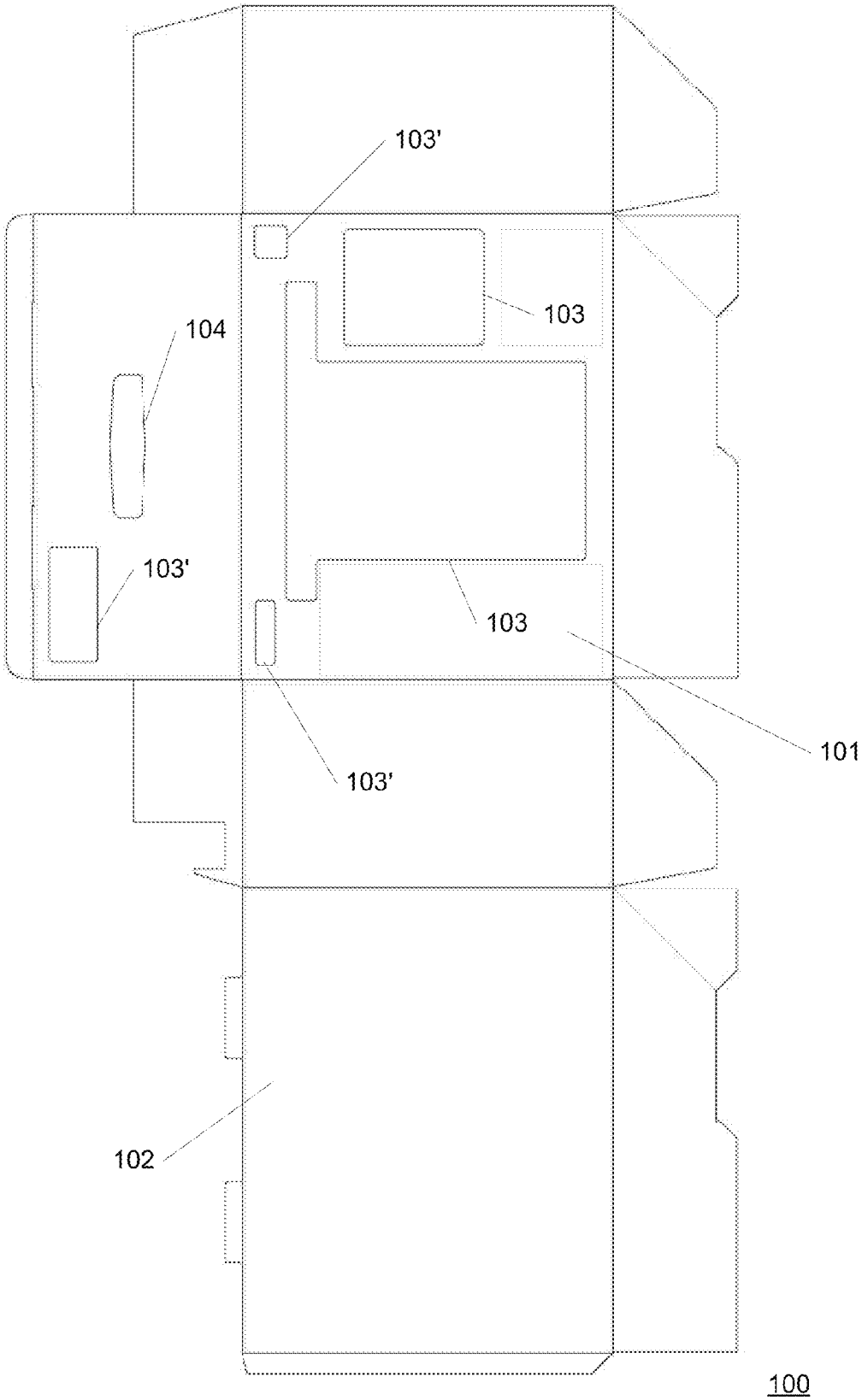
FIG. 3 schematically illustrates a view of an alternative embodiment of a game related bundle packaging in an un-folded state.

FIG. 3 schematically illustrates a view of an alternative embodiment of a game related bundle packaging in an un-folded state. Shown is game related bundle packaging (100) that corresponds to the one of FIG. 1 but where two additional windows (103') is located on the first side (101) revealing additional information of the original packaging of the game console and the game related item.

Figure 4:
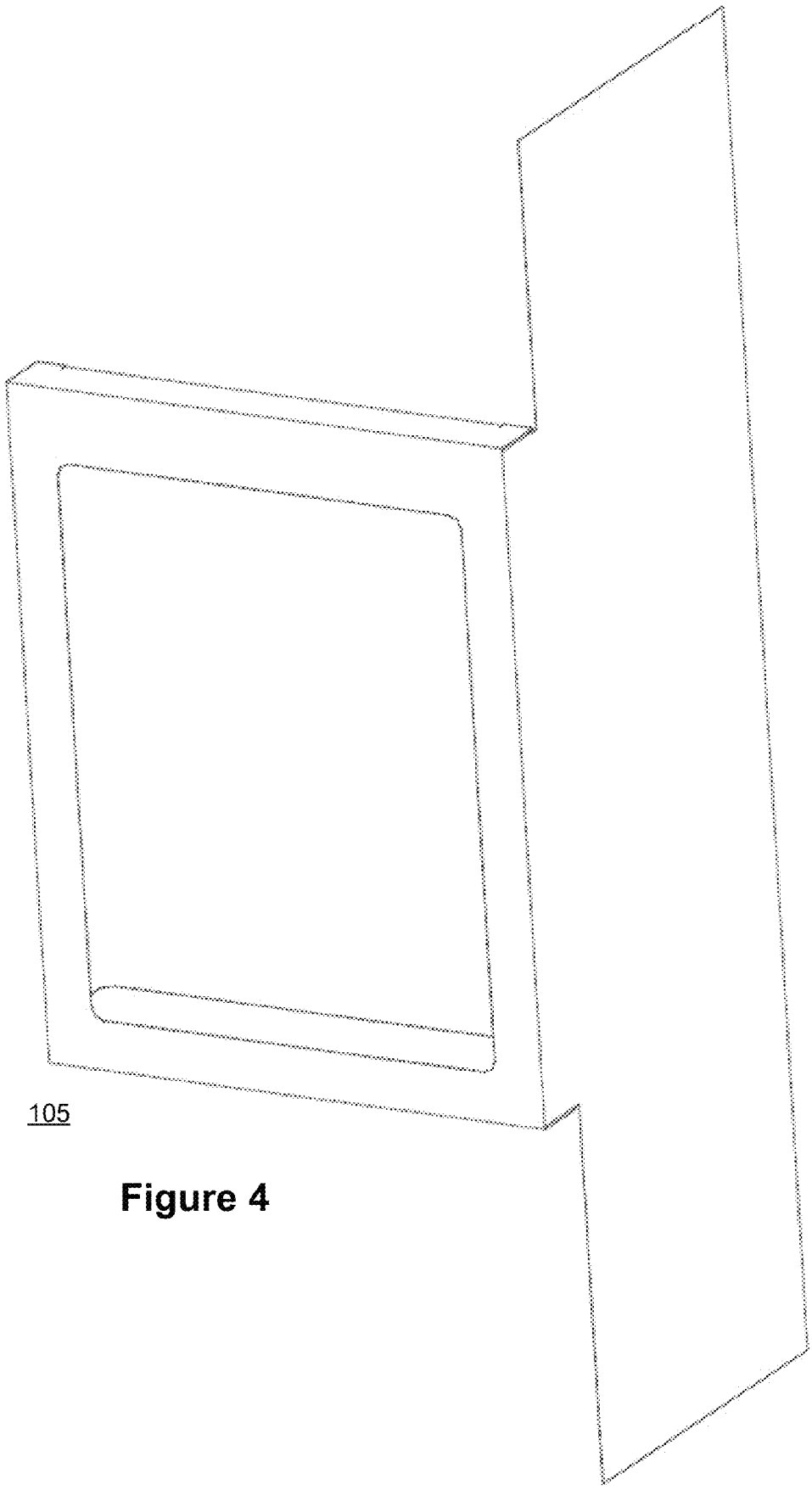
FIG. 4 schematically illustrates a perspective view of an inlay.

FIG. 4 schematically illustrates a perspective view of an inlay. Shown is an inlay (105) to keep or support a game in its proper location in a game related bundle packaging such as the ones of FIGS. 1-3 and 6-10.

Figure 5:
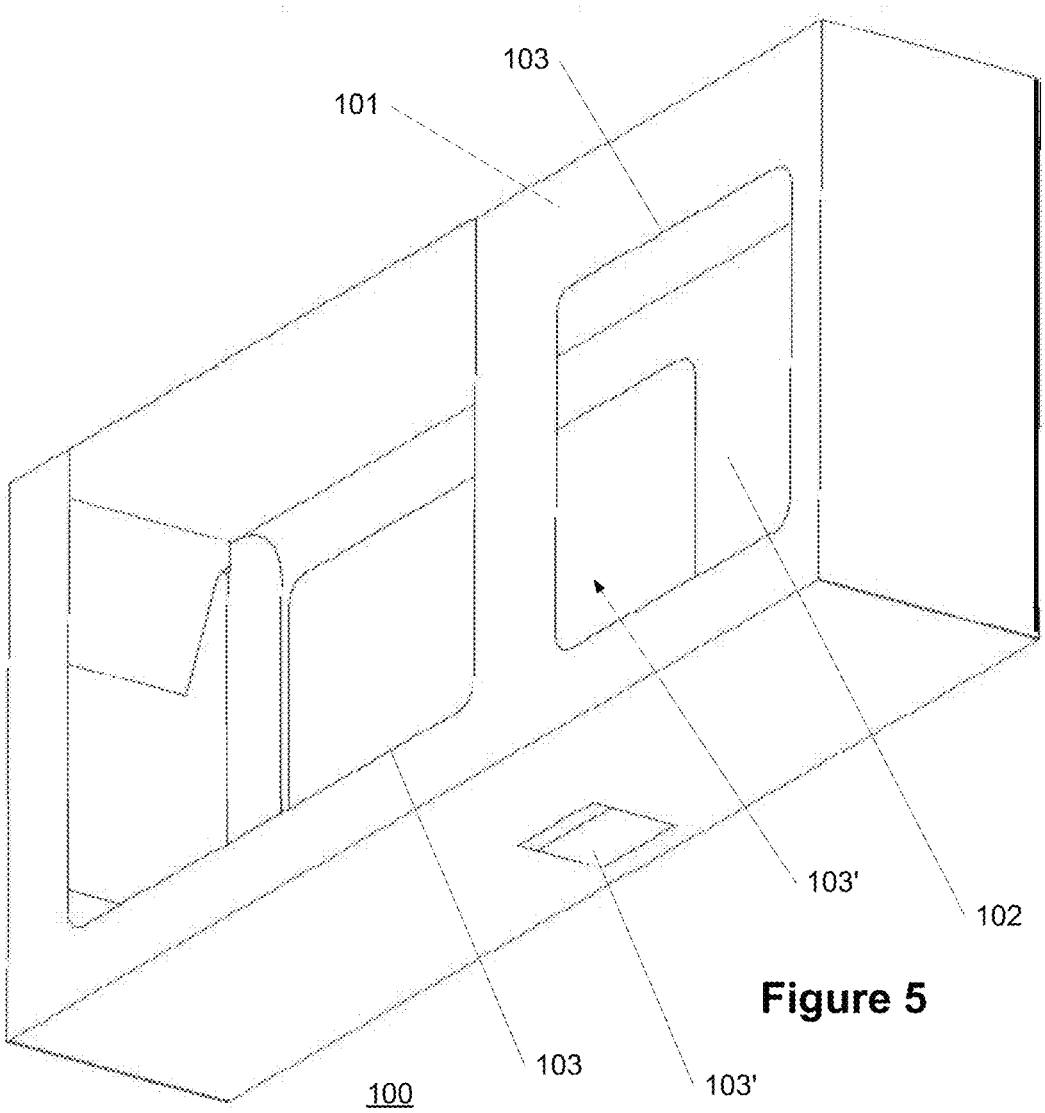
FIG. 5 schematically illustrates a perspective view of an alternative embodiment of a game related bundle packaging in a folded state.

FIG. 5 schematically illustrates a perspective view of an alternative embodiment of a game related bundle packaging in a folded state. Shown is a game related bundle packaging (100) (seen from below) in a folded state comprising a first side (101) and a second side (102).

The first side (101) comprises a first and at least a second window (103). The first window is of a predetermined first shape and size and is located at a first predetermined position on the first side (101) so that one at least a first area of interest of the original packaging of the specific game console is viewable from outside the game related bundle packaging (100) by a person when the game console is placed in the game related bundle packaging (100).

The second window (103) is of another predetermined second shape and size being at a second predetermined position on the first side (101) so that at least a second area of interest of the original packaging of the game related item is visible from outside the game related bundle packaging (100) by a person when the game related item is placed in the game related bundle packaging.

The game related bundle packaging (100) of FIG. 5 corresponds in function and possibilities to the packaging of the earlier figures but designed to accommodate another specific type of game console, namely a Nintendo DS, DS lite, or DSi console.

The game related bundle packaging (100) of FIG. 5 further comprises two additional windows (103'), one on the second or back side (102) and one at the bottom e.g. to show a barcode.

Figure 6:
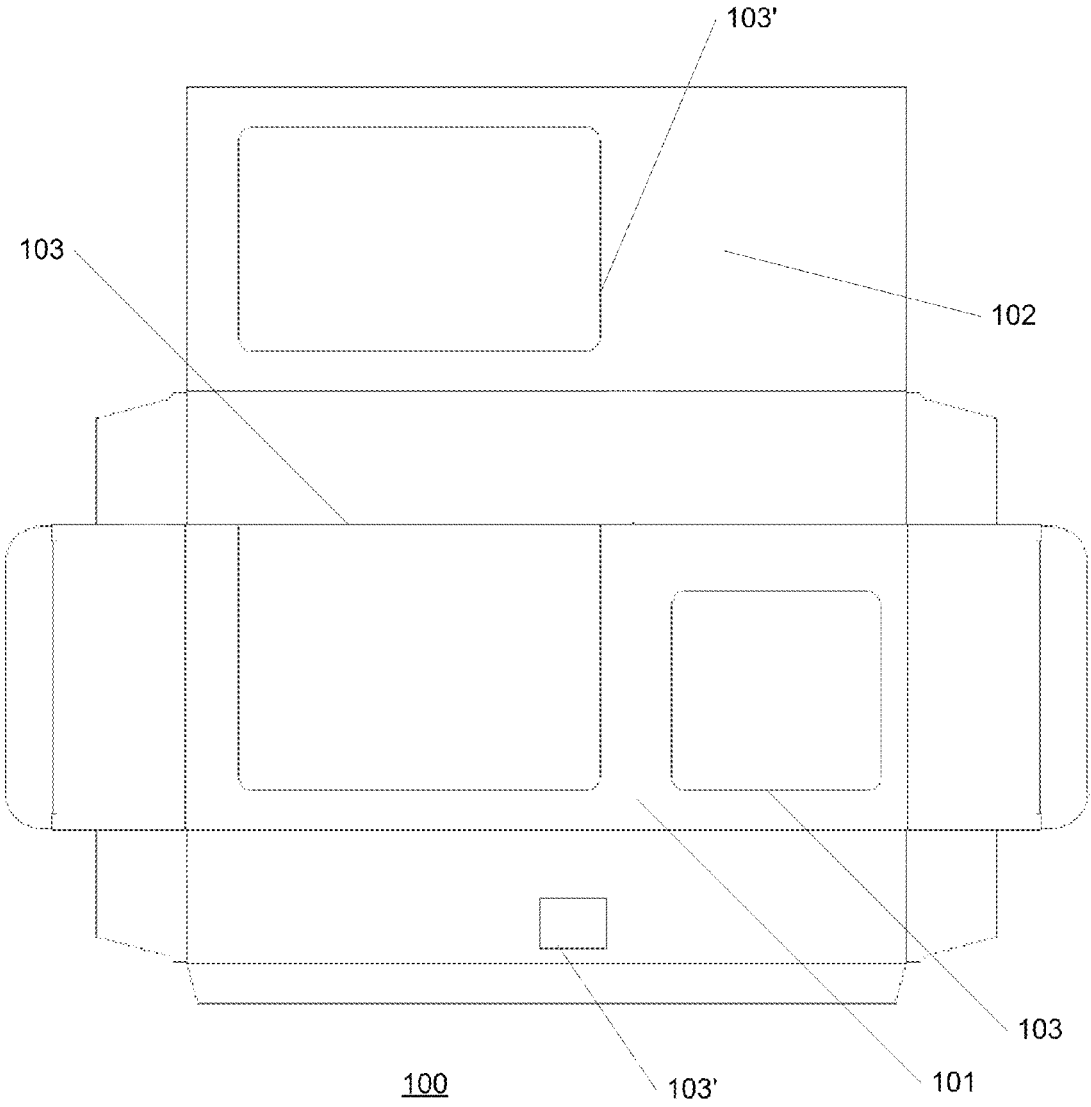
FIG. 6 schematically illustrates a view of the alternative embodiment of FIG. 5 in an un-folded state.

FIG. 6 schematically illustrates a view of the alternative embodiment of FIG. 5 in an un-folded state. Shown is an unfolded view a game related bundle box (100) corresponding to the one in FIG. 5.

Figure 7:
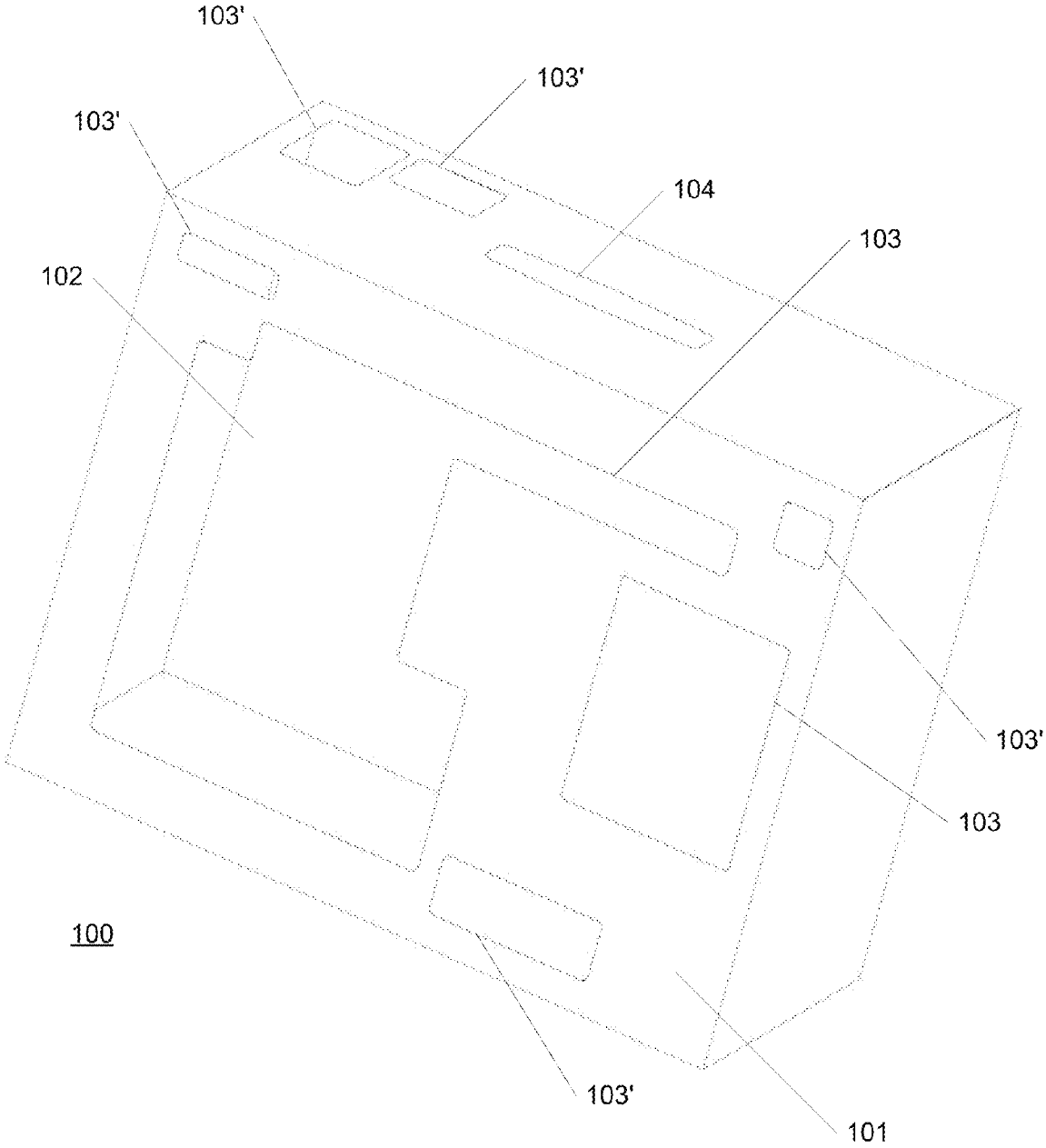
FIG. 7 schematically illustrates a perspective view of an alternative embodiment of a game related bundle packaging in a folded state.

FIG. 7 schematically illustrates a perspective view of an alternative embodiment of a game related bundle packaging in a folded state.

Shown is a game related bundle packaging (100) in a folded state comprising a first side (101) and at least a second side (102), where the game related bundle packaging (100) corresponds in function to the packaging shown and explained in connection with the previous figures.

The exemplary embodiment shown in FIG. 7 is designed to hold a PS3 in its original packaging in a first predetermined position and a game related item, in the form of a game, in its original packaging at another predetermined position.

The first side (101) comprises a first and a second window (103). The first window (103) is of a predetermined first shape and size and is located at a first predetermined position on the first side (101) (to the left) so that at least a first area of interest of the original packaging of the specific game console is viewable from outside the game related bundle packaging (100) by a person when the game console is placed in the game related bundle packaging (100).

The second window (103) is of another predetermined second shape and size being at a second predetermined position on the first side (101) (to the right) so that at least a second area of interest of the original packaging of the game related item—here in the form of a game—is visible from outside the game related bundle packaging (100) by a person when the game related item is placed in the game related bundle packaging.

The game related bundle packaging (100) also comprise three additional windows (103') on a first second side (101) and two additional windows (103') on a top or upper side to show additional information. The game related bundle packaging (100) also comprise a cut-out or the like (104) for accommodating a handle of the original packaging for a game console, e.g. like a PS3 packaging has.

One reason for having different layouts for the same game console (e.g. as shown in FIGS. 1 and 7) can be due to the original packaging being different on different markets, e.g. like in Europe and the USA.

Figure 8:
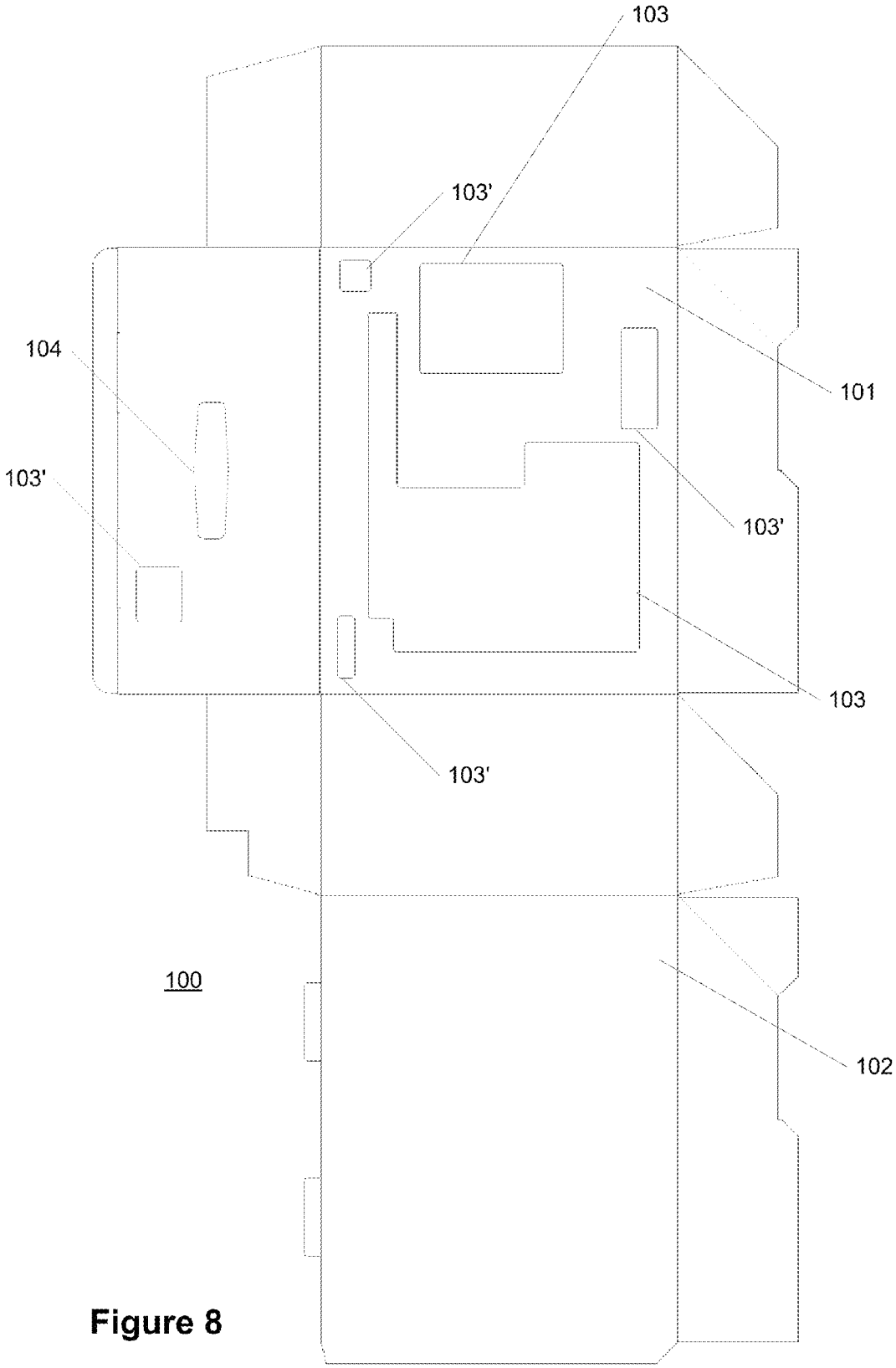
FIG. 8 schematically illustrates a view of the game related bundle packaging of FIG. 7 in an un-folded state.

FIG. 8 schematically illustrates a view of the game related bundle packaging of FIG. 7 in an un-folded state. Shown is game related bundle packaging (100) in an un-folded state comprising a first side (101) and a second side (102). Also shown are additional windows (103') on the first side (101) and on an upper side and a cut-out (104) for accommodating a handle of the original packaging for a game console.

Figure 9:
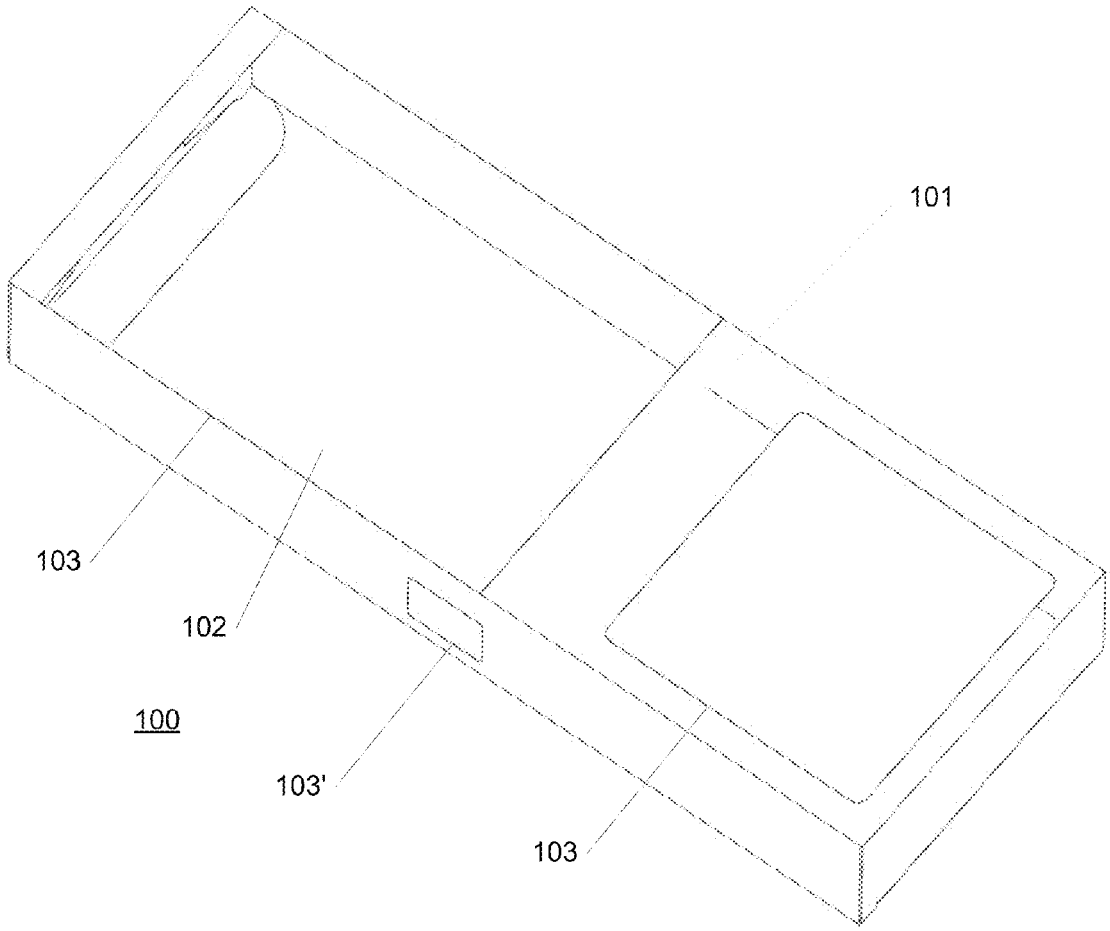
FIG. 9 schematically illustrates a perspective view of a yet another alternative embodiment of a game related bundle packaging in a folded state.

FIG. 9 schematically illustrates a perspective view of a yet another alternative embodiment of a game related bundle packaging in a folded state.

Shown is a game related bundle packaging (100) in a folded state comprising a first side (101) and a second side (102), where the game related bundle packaging (100) corresponds in function to the packaging shown and explained in connection with the previous figures.

The exemplary embodiment shown in FIG. 9 is designed to hold a Nintendo DS, a Nintendo DS lite, or a Nintendo DSi in its original packaging in a first predetermined position and a game related item, in the form of a game, in its original packaging at another predetermined position.

The first side (101) comprises a first and a second window (103). The first window (103) is of a predetermined first shape and size and is located at a first predetermined position on the first side (101) (to the left) so that one at least a first area of interest of the original packaging of the specific game console is viewable from outside the game related bundle packaging (100) by a person when the game console is placed in the game related bundle packaging (100).

The second window (103) is of another predetermined second shape and size being at a second predetermined position on the first side (101) (to the right) so that at least a second area of interest of the original packaging of the game related item—here in the form of a game—is visible from outside the game related bundle packaging (100) by a person when the game related item is placed in the game related bundle packaging.

The game related bundle packaging (100) also comprise one additional window (103') located on a bottom or lower side to show additional information, e.g. like a barcode of the original packaging of the game console.

Figure 10:
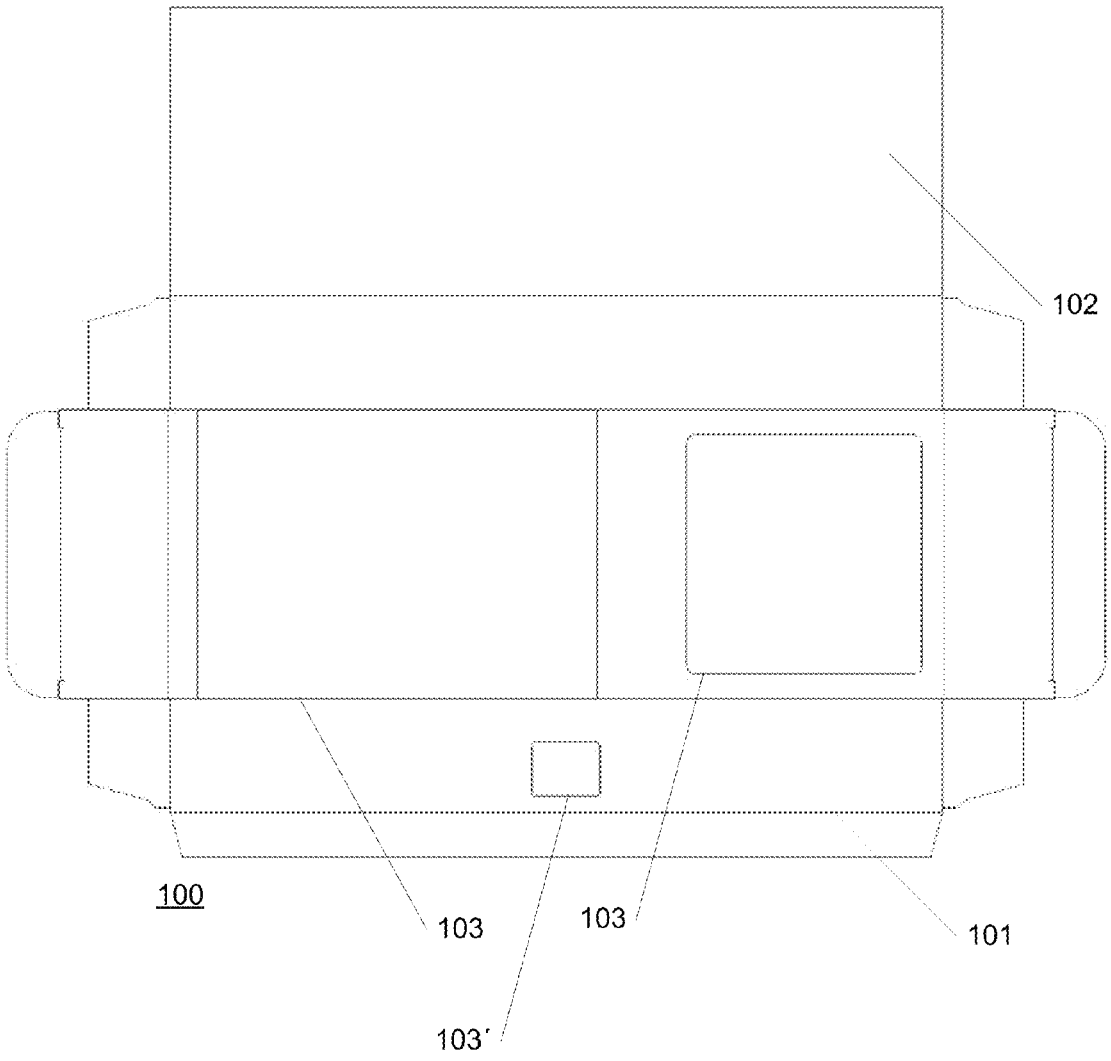
FIG. 10 schematically illustrates a view of the game related bundle packaging of FIG. 9 in an un-folded state.

FIG. 10 schematically illustrates a view of the game related bundle packaging of FIG. 9 in an un-folded state. Shown is game related bundle packaging (100) in an un-folded state comprising a first side (101) and a second side (102). Also shown is an additional window (103') on the bottom or lower side of the game related bundle packaging.

In the claims, the word "comprising" does not exclude the presence of elements or steps other than those listed in a claim. The word "a" or "an" preceding an element does not exclude the presence of several such elements.

The mere fact that certain measures are recited in mutually different dependent claims does not indicate that a combination of these measures cannot be used to advantage.

What is claimed is:

1. A game related bundle packaging comprising:

a first side and a second side, the game related bundle packaging holding a specific type of game console in its original packaging at a predetermined position within the game related bundle packaging and at least one game related item in its original packaging at another predetermined position within the game related bundle packaging, wherein the first side comprises, a first window of a predetermined first shape and size being at a first predetermined position on the first side, the predetermined first shape and size of the first window revealing at least one first area of interest of the original packaging of the specific game console when the specific game console is placed in the game related bundle packaging, and at least one second window of a predetermined second shape and size being at a second predetermined position on the first side, the predetermined second shape and size of the second window revealing at least one second area of interest of the original packaging of the at least one game related item when the at least one game related item is placed in the game related bundle packaging, wherein the at least one first area of interest revealed by the first window comprises information relating to one or more of: a manufacturer of the specific game console, a name of the specific game console, a barcode of the original packaging of the specific game console, technical specifications, commercial information, and at least a part of a picture or image showing the specific game console, and wherein the at least one second area of interest revealed by the second window comprises one or more of: at least one console game, at least one game controller, at least one game accessory, at least one game hint book or guide, and combinations thereof.

2. The game related bundle packaging according to claim 1, wherein one or more of the first window and the second window is a cut-out or a transparent portion in the game related bundle packaging.

3. The game related bundle packaging according to claim 1, wherein the at least one second area of interest includes information relating to one or more of: an age rating, at least a part of a cover of a console game, a barcode of the original packaging of the game related item, number of players for a console game, technical specifications, commercial information, and online capabilities.

4. The game related bundle packaging according to claim 1, wherein the game related bundle packaging comprises one or more identifiers of a retailer of the game related bundle packaging.

5. The game related bundle packaging according to claim 1, wherein the game related bundle packaging comprises one or more of: a voucher, a coupon, and a redeemable code of a predetermined value being redeemable by a retailer of the game related bundle packaging.

6. The game related bundle packaging according to claim 1, wherein the game related bundle packaging comprises one or more of: one or more additional windows on the second side, and one or more additional windows on additional sides of the game related bundle packaging, the additional windows revealing at least one additional area of interest.

7. The game related bundle packaging according to claim 1, wherein the game related bundle packaging comprises printed information.

8. The game related bundle packaging according to claim 7, wherein the printed information comprises one or more of: a game console name, a game console logo, a name of a developer or distributor of a game, a gaming accessory name, a gaming accessory logo, a game name, a game logo, a game cover, a design of a game, and advertising information.

9. The game related bundle packaging according to claim 1, comprising a third window of a predetermined third shape and size being at a third predetermined position on a side of the game related bundle packaging, the predetermined third shape and size of the third window revealing a handle integrated into the original packaging of the specific game console.

* * * * *